United States Patent [19]

Tenhover et al.

[11] Patent Number: 4,585,617

[45] Date of Patent: Apr. 29, 1986

[54] AMORPHOUS METAL ALLOY COMPOSITIONS AND SYNTHESIS OF SAME BY SOLID STATE INCORPORATION/REDUCTION REACTIONS

[75] Inventors: Michael A. Tenhover; Richard S. Henderson, both of Solon; Robert K. Grasselli, Aurora, all of Ohio

[73] Assignee: The Standard Oil Company, Cleveland, Ohio

[21] Appl. No.: 751,704

[22] Filed: Jul. 3, 1985

[51] Int. Cl.[4] ..... B22F 7/00

[52] U.S. Cl. ..... 419/5; 419/8; 419/34; 419/45; 419/46; 148/11.5 P; 148/403; 148/126.1; 148/127; 75/0.5 A; 75/0.5 AB; 75/0.5 AC; 75/0.5 B; 75/0.5 BB; 75/0.5 BC; 75/251

[58] Field of Search ..... 148/403, 11.5 P, 126.1, 148/127; 75/251, 252, 0.5 B, 0.5 BA, 0.5 BB, 0.5 BC, 0.5 A, 0.5 AA, 0.5 C

[56] References Cited

U.S. PATENT DOCUMENTS

| | | | |
|---|---|---|---|
| 4,067,732 | 1/1978 | Ray | 148/403 |
| 4,197,146 | 4/1980 | Frischman | 75/251 |
| 4,282,034 | 8/1981 | Smith et al. | 75/251 |
| 4,318,738 | 3/1982 | Masumoto et al. | 148/403 |
| 4,537,624 | 8/1985 | Tenhover et al. | 148/11.5 P |
| 4,537,625 | 8/1985 | Tenhover et al. | 148/11.5 P |

*Primary Examiner*—Stephen J. Lechert,Jr.

*Attorney, Agent, or Firm*—Thomas P. Schur; Joseph G. Curatolo; Larry W. Evans

[57] ABSTRACT

Amorphous metal alloy compositions are synthesized by solid state incorporation/reduction reactions wherein a high-surface area support is brought in contact with a precursor metal-bearing compound in such a manner that the compound is incorporated into the support or caused to deposit metal onto the surface of the support. The composition obtained is an amorphous alloy composition or can be made so by heat treating at a temperature below the crystallization temperature of the amorphous metal alloy desired to be formed.

21 Claims, No Drawings

AMORPHOUS METAL ALLOY COMPOSITIONS AND SYNTHESIS OF SAME BY SOLID STATE INCORPORATION/REDUCTION REACTIONS

FIELD OF THE INVENTION

This invention relates to amorphous metal alloy compositions and the novel preparation of such alloys by solid state reactions. More specifically, this invention relates to the incorporation and synthesis of amorphous metal alloy compositions by the incorporation and chemical or thermal reduction of metal-bearing compounds.

BACKGROUND OF THE INVENTION

Amorphous metal alloy materials have become of interest in recent years due to their unique combination of mechanical, chemical and electrical properties that are especially well-suited for many technical applications. Examples of amorphous metal material properties include the following:

uniform electronic structure,
compositionally variable properties,
high hardness and strength,
flexibility,
soft magnetic and ferroelectric properties,
very high resistance to corrosion and wear,
unusual alloy compositions, and
high resistance to radiation damage.

Of special interest are amorphous alloys having enhanced soft magnetic, ferroelectric and corrosion resistant properties. Such materials would be ideally suited for producing high efficiency powerline transformers and windings for motors.

The unique combination of properties of amorphous metal alloy materials may be attributed to the disordered atomic structure of amorphous materials which ensures that the material is chemically homogeneous and free from the extended defects, such as dislocations and grain boundaries, that are known to limit the performance of crystalline materials. The amorphous state is characterized by a lack of long range periodicity, whereas a characteristic of the crystalline state is its long range periodicity.

Generally, the room temperature stability of amorphous materials depends on various kinetic barriers to the growth of crystal nuclei and to nucleation barriers that hinder the formation of stable crystal nuclei. Such barriers typically are present if the material to be made amorphous is first heated to a molten state, then rapidly quenched or cooled through the crystal nucleation temperature range at a rate that is sufficiently fast to prevent significant nucleation to occur. Such cooling rates are on the order of $10^{6}$° C./second. Rapid cooling dramatically increases the viscosity of the molten alloy and quickly decreases the length over which atoms can diffuse. This has the effect of preventing crystalline nuclei from forming and yields a metastable, or amorphous, phase.

Processes that provide such cooling rates include sputtering, vacuum evaporation, plasma spraying and direct quenching from the liquid state. It has been found that alloys produced by one method often cannot be similarly produced by another method even though the pathway to formation is in theory the same.

Direct quenching from the liquid state has found the greatest commercial success since a variety of alloys are known that can be manufactured by this technique in various forms such as thin films, ribbons and wires. U.S. Pat. No. 3,856,513 to Chen et al. describes novel metal alloy compositions obtained by direct quenching from the metal and includes a general discussion of this process. Chen et al. describes magnetic amorphous metal alloys formed by subjecting the alloy composition to rapid cooling from a temperature above its melting temperature. A stream of the molten metal is directed into the nip of rotating double rolls maintained at room temperature. The quenched metal, obtained in the form of a ribbon, was substantially amorphous as indicated by x-ray diffraction measurements, was ductile, and had a tensile strength of about 350,000 psi.

U.S. Pat. No. 4,036,638 to Ray et al. describes binary amorphous alloys of iron or cobalt and boron. The claimed amorphous alloys were formed by a vacuum melt-casting process wherein molten alloy was ejected through an orifice and against a rotating cylinder in a partial vacuum of about 100 millitorr. Such amorphous alloys were obtained as continuous ribbons and all exhibited high mechanical hardness and ductility.

The thickness of essentially all amorphous foils and ribbons formed by rapid cooling from the melt are limited by the rate of heat transfer through the material. Generally, the thickness of such films is less than 50 microns. The few materials that can be prepared in this manner include the disclosed by Chen et al. and Ray et al.

Amorphous metal alloy materials prepared by electrodeposition processes have been reported by Lashmore and Weinroth in Plating and Surface Finishing, 72 (August 1982). These materials include Co—P, Ni—P, Co—Re and Co—W compositions. However, the as-formed alloys are inhomogeneous and so can be used in only limited applications.

The above-listed prior art processes for producing amorphous metal alloys depend upon controlling the kinetics of the solidification process; controlling the formation of the alloy from the liquid (molten) state or from the vapor state by rapidly removing heat energy during solidification. Most recently, an amorphous metal alloy composition was synthesized without resort to rapid heat removal. Yeh et al. reported that a metastable crystalline compound $Zr_3Rh$, in the form of a thin film, could be transformed into a thin-film, amorphous metal alloy by the controlled introduction of hydrogen gas; Applied Physics Letter 42(3), pp 242–244, Feb. 1, 1983. The amorphous metal alloy had an approximate composition of $Zr_3RhH_{5.5}$.

Yeh et al. specified three requirements as prerequisites for the formation of amorphous alloys by solid state reactions: at least a three component system, a large disparity in the atomic diffusion rates of two of the atomic species, and an absence of a polymorphic crystalline alternative as a final state. Thus, Yeh et al. teaches that solid state reactions would have limited applications for the synthesis of amorphous metal alloy materials.

Sawmer disclosed the formation of amorphous Zr—Co alloys by a solid state reaction in a multilayer configuration, Fifth International Conference on Rapidly Quenched Metals, Wurzburg, Germany, September, 1984. Zirconium and cobalt films, having thicknesses between 100 and 500 Angstroms, are layered together and heat treated at a temperature of about 180° C. A diffusion process formed an amorphous Zr—Co phase at the interface of each adjacent layer.

The known amorphous metal alloys and processes for making such alloys discussed above suffer from the disadvantage that the so-formed amorphous alloy is produced in a limited form, that is, as a thin film such as a ribbon, wire or platelet. These limited shapes place severe restrictions on the applications for which amorphous metal materials may be used.

To produce bulk amorphous metal alloy objects, the formed amorphous alloy must be mechanically reduced to a powder as by chipping, crushing, grinding and ball milling and then recombined in the desire shape. These are difficult processes when it is realized that most amorphous metal alloys have high mechanical strengths and also possess a high degree of hardness.

What is lacking in the area of amorphous metal alloy preparation is a simple process for the direct formation of a large variety of amorphous metal alloys. Especially lacking is a process that would synthesize amorphous metal alloy materials directly as powders suitable for forming bulk amorphous metal alloy shapes.

Hence, it is one object of the present invention to provide novel amorphous metal alloy compositions.

It is another object of the present invention to provide a process for the direct preparation of a large variety of homogeneous amorphous metal alloy compositions.

It is a further object of the present invention to provide a process for the direct preparation of a large variety of homogeneous amorphous metal alloy compositions in a powder form.

It is still another object of the present invention to provide a process for the direct preparation of a large variety of homogeneous amorphous metal alloy powders by solid state reactions.

These and additional objects of the present invention will become apparent in the description of the invention and examples that follow.

SUMMARY OF THE INVENTION

The present invention relates to a process for the synthesis of a substantially amorphous metal alloy which comprises contacting a high surface area support material with at least one precursor metal-bearing compound at a temperature below the crystallization temperature of the amorphous metal alloy to be formed so that metal from the precursor metal-bearing compound is disposed on the high surface area support and combines to form the substantially amorphous metal alloy.

The invention further relates to a process for the synthesis of a substantially amorphous metal alloy comprising the steps of (a) disposing a high-surface area support in contact with at least one precursor metal-bearing compound so as to incorporate said compound onto said support;
(b) reducing the at least one precursor metal-bearing compound so as to deposit metal on the support and to form a reactive composition; and
(c) heat treating the reactive composition so as to form a substantially amorphous metal alloy, the heat treating occurring at a temperature below the crystallization temperature of the amorphous metal alloy.

DETAILED DESCRIPTION OF THE INVENTION

In accordance with this invention, there are provided novel processes for the synthesis of substantially amorphous metal alloys. The term "substantially" as used herein with reference to the synthesized amorphous metal alloys means that the synthesized alloys described herein are at least fifty percent amorphous, preferably at least eighty percent amorphous and most preferably about one hundred percent amorphous, as indicated by x-ray diffraction analyses. The use of the phrase "amorphous metal alloys" as used herein refers to amorphous metal-containing alloys that may also comprise non-metallic elements. Amorphous metal alloys may include non-metallic elements such as boron, carbon, nitrogen, silicon, phosphorus, arsenic, germanium and antimony.

The high surface area support suitable for use in this invention includes materials having an average surface area of at least about 20 $m^2/gm$, preferably materials having an average surface area of at least about 40 $m^2/gm$, and most preferably materials having an average surface area of at least about 50 $m^2/gm$. Examples of such high surface area support materials include high surface area forms of SiC, $TiB_2$, BN, Raney nickel, phosphorus, titanium, neodymium and yttrium. These high-surface area supports may be provided in the form of particles or as compacted shapes, provided the shapes are sufficiently porous to permit infiltration of the precursor metal-bearing compounds therein. Preferably, these supports are powders so as to permit the synthesis of amorphous metal alloy powders.

The precursor metal-bearing compounds suitable for use in this invention may include organometallic compounds such as monomers, dimers, trimers and polymers having metallo-organic ligands composed of saturated and/or unsaturated hydrocarbons, aromatic or heteroaromatic ligands, and may also include oxygen, boron, carbon, nitrogen, phosphorus, arsenic and/or silicon-containing ligands, and combinations thereof. Precursor metal-bearing compounds may also be halogen compounds, oxides, nitrates, nitrides, carbides, borides or metal-bearing salts. Still other precursor compounds may be sulfates, chlorides, bromides, iodides, fluorides, phosphates, hydroxides, perchlorates, carbonates, tetrafluoroborates, trifluoromethane sulfonates, hexafluorophosphates, sulfonate, or 2,4-pentanedionate. The precursor compounds may exist at ambient temperatures as solids, liquids or gases.

The solid state process as disclosed herein includes causing the precursor metal-bearing compound to deposit metal onto the high surface area support material. This may be accomplished, for example, by thermally decomposing the precursor metal-bearing compound in the presence of the high surface area support material. The precursor compound is selected to decompose at a temperature below the crystallization temperature of the amorphous alloy to be formed. Preferably the precursor compound will decompose at a temperature of at least 100° C. below the crystallization temperature of the amorphous alloy to be formed.

The deposited metal reacts with the high surface area support so as to form an amorphous metal alloy. This may occur simultaneously with decomposition or may occur later with addtional heat treating.

The precursor metal-bearing compound may also cause metal to be disposed on the high surface area support by reducing the at least one precursor compound in the presence of the high surface area support. Reduction of the precursor compound may be achieved by means of a reducing agent or by electrochemical reduction or photocatalytic reduction.

Once the metal has been disposed in intimate contact with the high surface area support, a subsequent heat-treating step may be used to obtain the amorphous metal alloy.

Disposing metal on the high surface area support may be achieved by a variety of wel-known techniques. A fixed bed of the high surface area support may be subjected to elevated temperatures or a reducing atmosphere or electrochemical conditions, such that a precursor metal-bearing compound introduced to the high surface area support will cause metal to be deposited on the support. Such a technique could also be made continuous, as by the use of a tunnel kiln.

The most preferred technique is to suspend the high surface area support in a solution containing the precursor compound therein and to then chemically reduce the precursor compound thereby depositing metal onto the support. The liquid medium may be suitably chosen in view of the precursor metal-bearing compounds utilized in the particular reduction reaction. The liquid medium is preferably a solvent that may be aqueous or an alcohol such as methanol, ethanol, isopropyl alcohol and higher molecular weight alcohols, or other organic solvents or mixtures thereof. Most preferably the solvent is an aqueous solvent. Examples of reducing agents that are suitable for this technique include hydrogen, hydrazine and sodium borohydride. The chemical reduction process occurs at any temperature below the crystallization temperature of the amorphous metal alloy to be formed. Preferably the process occurs at about room temperature. In this preferred embodiment, the high surface area support material may be in the form of particles, having a surface area of at least about 20 $m^2/gm$.

Thus, for example, the chemical reduction of iron salts and/or other iron-containing compounds on high surface area supports such as BN or $TiB_2$, followed by subsequent low temperature processing will produce an amorphous ferromagnetic alloy material in accordance with the process of this invention.

EXAMPLES

The invention will be more clearly understood by the following examples which are presented herein to illustrate the invention and are not intended in any way to be limitative thereof.

EXAMPLES 1–4

These examples contrast the synthesis of amorphous metal alloys in accordance with the present invention, whereby a precursor metal-bearing compound is contacted with a high surface area support material of silicon carbide, with a control run wherein fine metal particles are substituted for the precursor metal-bearing compound.

In the examples, an amount of silicon carbide powder, characterized by having a particle size distribution wherein the maximum particle size was less than about 74 microns and an average surface area of about 50 $m^2/gm$, were suspended in about 100 ml of distilled water by rapid mechanical stirring. A predetermined amount of a precursor metal-bearing compound or elemental particles of the metal were then dispersed in the distilled water in which the silicon carbide has been suspended. This aqueous suspension was degassed with argon. Next, an argon-degassed solution of about 100 mmol of sodium borohydride, $NaBH_4$, dissolved in about 100 ml of distilled water was added dropwise over a period of about two hours to form a suspension. After the addition was completed, the suspension was stirred for about 16 hours to insure that the reaction had gone to completion. The aqueous solution was cannulated away from the solids and the solids were washed with two 50 ml portions of distilled water. The solids were then dried under a vacuum at about 60° C. for about four hours, then sealed in a pyrex tube under vacuum and heat treated at about 290° C. for about 21 days.

In Example 1, about 10 mmol of silicon carbide powder and about 40 mmol of iron chloride $FeCl_2.4H_2O$ were used in the reaction process described above. The product obtained after this process was examined by X-ray diffraction which indicated that the solids comprised an amorphous material of approximate composition $Fe_{80}Si_{10}C_{10}$. This example demonstrates the formation of a novel amorphous metal alloy composition by the process disclosed herein.

The same procedure was repeated for Example 2 with the exception that in place of the about 40 mmol of iron chloride, about 40 mm of iron particles having a particle size distribution wherein the maximum particle size was less than about 44 microns where suspended along with 10 mmol of silicon carbide powder in the aqueous solution. The solids product obtained after 21 days of heat treating at about 290° C. in this example had a composition of about $Fe_{80}Si_{10}C_{10}$, but was not amorphous as indicated by X-ray diffraction data. This control run demonstrates that physical mixing alone is not sufficient to obtain a substantially amorphous material. Rather a solid state incorporation/reduction process, as depicted in Example 1, is necessary for the formation of a desired amorphous material.

In Example 3 the amount of silicon carbide and iron chloride used in Example 1 was adjusted so that the solids product obtained after the reaction in the aqueous solution had an approximate composition $Fe_{10}Si_{45}C_{45}$. After heat treating in the manner described above, the product was analyzed by X-ray diffraction and shown to comprise partially amorphous FeSiC and excess silicon carbide.

In Example 4 the process taught in Example 3 was repeated with the exception that iron chloride was replaced with potassium platinum chloride, $K_2PtCl_4$. The solids product obtained after the reaction in solution had an approximate composition $Pt_{10}Si_{45}C_{45}$. After heat treating at about 290° C. for about 10 days, a product was obtained that upon X-ray diffraction analysis was seen to comprise amorphous PtSiC and excess silicon carbide.

EXAMPLES 5–8

In Examples 5–8, the process taught herein is exemplified with the use of one or more various precursor metal-bearing compounds and various high surface area supports.

In Example 5, about 7 mmol of phosphorus powder, characterized by a particle size distribution wherein the maximum particle size was about 149 microns were suspended in about 100 ml of distilled water by rapid mechanical stirring. About 7 mmol of iron chloride and about 14 mmol of nickel chloride, $NiCl_2.6H_2O$, were then dissolved in the distilled water into which the phosphorus had been suspended. This aqueous solution was degassed with argon and an argon-degassed solution of about 50 mmol of sodium borohydride dissolved in about 100 ml of distilled water was added dropwise over a period of about two hours to form a suspension. After the addition was completed, the reactive suspension was stirred for about 16 hours to insure that the reaction had been completed. The aqueous solution was cannulated away from the solids and the solids were washed with 250 ml portions of distilled water. The solids were then dried under a vacuum at about 60° C. for about four hours, and determined to have a mixture composition of about $FeNi_2BP$. The solids were sealed in a pyrex tube under vacuum and heat treated at about 250° C. for about 10 days. After heat treating, X-ray diffraction data indicated that the solids comprised a material of approximate composition $FeNi_2BP$ that was at least 50 percent amorphous.

In Example 6, the process described in Example 5 above, was repeated wherein the phosphorous particles were replaced with yttrium particles having a maximum particle size of about 149 microns and the precursor metal-bearing compound was iron chloride. About 10 mmol of yttrium and 10 mmol of iron chloride were utilized in solution to yield a solids product after reaction of approximate composition $Fe_{50}Y_{50}H_x$. After heat treating, the solids product was analyzed by X-ray diffraction and found to be an amorphous material having a composition of approximately FeY.

The high surface area support material comprised $Cr_2MoP$ particles having a maximum particle size of about 149 microns in Example 7. The precursor metal-bearing compounds in this example were iron chloride and nickel chloride. These reactants were utilized in the process described above for Example 5 to yield a mixture after reaction of approximate formula $Fe_{36}N_{16}B_8Cr_{20}Mo_{10}P_{10}$. After heat treating at about 290° C. for about 14 days, a solids product was recovered and analyzed by X-ray diffraction data. The products were then determined to be an amorphous composition of about $Fe_{36}Ni_{16}B_8Cr_{20}Mo_{10}P_{10}$. A slight excess of Mo was also detected.

EXAMPLES 8–11

These examples demonstrate variations of the process disclosed herein by utilizing the same high surface area support, but achieving an amorphous metal material through different derivative steps. Each Example utilized titanium particles, having a maximum particle size of about 74 microns as the high surface area support. Examples 8–10 were performed in accordance with the process taught in Examples 1 and 5 above. The precursor metal-bearing compound, solids composition after reaction, heat treating temperature, heat treating time and final solids composition are listed below in Table I. As can be seen from the table, each Example produced an amorphous metal solids composition as a final product. The process in accordance with claim 8 produced an amorphous metal composition after the solution reaction step.

In Example 11, equimolar amounts of nickel acrylonitrile polymer $[Ni(AN)_2]_x$ and titanium particles were physically mixed together and heated in an oil bath. The temperature of the oil bath was increased from about 70° C. to about 125° C. over about a two hour period. The temperature was maintained at about 125° C. for about 16 hours to completely decompose the nickel acrylonitrile polymer, leaving behind a residue comprising nickel and titanium. This residue was sealed in a pyrex tube under vacuum and heat treated at about 300° C. for about 10 days. X-ray diffraction data indicated that the resultant product comprised an amorphous material of approximate composition NiTi and a slight excess of titanium.

TABLE 1

| Example | Precursor Compound | Support | Solids Composition After Reaction | Heat Treating Temperature (°C.) | Heat Treating Period (hrs.) | Final Solids Composition |
|---|---|---|---|---|---|---|
| 8 | $FeCl_2$ | Ti | amorphous $Fe_{50}Ti_{50}H_x$ | 290 | 240 | amorphous $Fe_{50}Ti_{50}$ |
| 9 | $FeCl_2$ and $K_2PdCl_4$ | Ti | $Fe_{25}Pd_5Ti_{70}$ | 200 | 120 | amorphous FePdTi and excess Ti |
| 10 | $K_2PdCl_4$ | Ti | $Pd_{30}Ti_{70}$ | 300 | 240 | amorphous PdTi and excess Ti |
| 11 | $[Ni(AN)_2]_x$ | Ti | $Ni_{50}Ti_{50}$ | 300 | 240 | amorphous NiTi and excess Ti |

EXAMPLES 12–13

In these Examples, a neodymium-containing, magnetic amorphous alloy was intended to be formed in accordance with the process taught herein. The process steps detailed in Examples 1 and 5 were repeated for Examples 12 and 13. The high surface area support material in these examples was neodymium particles having a maximum particle size of about 420 microns. The precursor metal-bearing compounds used in the reaction were iron chloride and cobalt chloride. The reaction was precipitated by the use of a reduction agent, sodium borohydride.

In Example 12 the resultant product had a composition of about $Nd_{11}Fe_{68}Co_{14}B_7$. X-ray diffraction analysis indicated that the compound was crystalline.

In Example 13, the reactant amounts were altered so that an increased portion of the final composition comprised neodymium. The final composition in this Example was approximately $Nd_{17}Fe_{62}Co_{14}B_7$ and was determined to be amorphous by X-ray diffraction data.

The above-described examples demonstrate the formation of novel amorphous metal alloy compositions by the process disclosed herein, wherein a precursor metal-bearing compound is deposited on a high surface area support material by chemical reduction or thermal decomposition.

The selection of high surface area supports, precursor materials, reducing means, heat-treating temperatures and other reactant conditions can be determined from the preceeding Specification without departing from the spirit of the invention herein disclosed and described. The scope of the invention is intended to include modifications and variations that fall within the scope of the appended claims.

We claim:

1. A process for the synthesis of a substantially amorphous metal alloy which comprises contacting a high surface area support material with at least one precursor metal-bearing compound at a temperature below the crystallization temperature of the amorphous metal alloy to be formed so that metal from the precursor metal-bearing compound is disposed on the high surface area support and combined to form the substantially amorphous metal alloy.

2. The process in accordance with claim 1 wherein said substantially amorphous metal alloy is at least fifty percent amorphous.

3. The process in accordance with claim 1 wherein said substantially amorphous metal alloy is at least eighty percent amorphous.

4. The process in accordance with claim 1 wherein said substantially amorphous metal alloy is about 100 percent amorphous.

5. The process in accordance with claim 1 wherein said high surface area support has a surface area of at least 20 $m^2/gm$.

6. The process in accordance with claim 1 wherein said high surface area support has a surface area of at least 40 $m^2/gm$.

7. The process in accordance with claim 1 wherein said high surface area support has a surface area of at least 50 $m^2/gm$.

8. A process for the synthesis of a substantially amorphous metal alloy comprising the steps of (a) disposing a high-surface area support in contact with at least one precursor metal-bearing compound so as to incorporate said compound onto said support;

(b) reducing the at least one precursor metal-bearing compound so as to deposit metal on the support and to form a reactive composition; and (c) heat treating the reactive composition so as to form a substantially amorphous metal alloy, the heat treating occurring at a temperature below the crystallization temperature of the amorphous metal alloy.

9. The process in accordance with claim 8 wherein said substantially amorphous metal alloy is at least fifty percent amorphous.

10. The process in accordance with claim 8 wherein said substantially amorphous metal alloy is at least eighty percent amorphous.

11. The process in accordance with claim 8 wherein said substantially amorphous metal alloy is about 100 percent amorphous.

12. The process in accordance with claim 8 wherein said high surface area support has a surface area of at least 20 $m^2/gm$.

13. The process in accordance with claim 8 wherein said high surface area support has a surface area of at least 40 $m^2/gm$.

14. The process in accordance with claim 8 wherein said high surface area support has a surface area of at least 50 $m^2/gm$.

15. The process in accordance with claim 8 wherein said high-surface area support is selected from the group consisting of SiC, $TiB_2$, BN, Raney nickel, phosphorus, titanium, neodymium and yttrium.

16. The process in accordance with claim 8 wherein said high-surface area support is SiC.

17. The process in accordance with claim 8 wherein said metal-bearing compound is an organo-metallic compound.

18. The process in accordance with claim 8 wherein said metal-bearing compound is selected from the group consisting of halogens, oxides, nitrates, nitrides, carbides, borides and metal-bearing salts.

19. The process in accordance with claim 8 wherein said precursor metal-bearing compound is reduced by a chemical reduction agent.

20. The process in accordance with claim 19 wherein said chemical reduction agent is selected from the group consisting of hydrogen, hydrazine and sodium borohydride.

21. The process in accordance with claim 8 wherein said high-surface area support is disposed in a liquid medium.

* * * * *